United States Patent [19]

Andrews et al.

[11] 4,057,208

[45] Nov. 8, 1977

[54] SLIDE CAM ASSEMBLY FOR RAILROAD-CROSSING GATE MECHANISM

[75] Inventors: Frank Andrews, Chicago; Richard W. McKee, Lake Bluff, both of Ill.

[73] Assignee: Federal Signal Corporation, Oak Brook, Ill.

[21] Appl. No.: 659,100

[22] Filed: Feb. 18, 1976

[51] Int. Cl.[2] ..... B61L 29/04; B61L 29/08

[52] U.S. Cl. ..... 246/125; 49/138; 49/334; 246/293

[58] Field of Search ..... 49/13, 32, 107, 138, 49/334; 246/125, 127, 261, 272, 292, 293; 74/568 R, 568 M; 200/6 BB, 31 R, 31 A, 38 BA, 153 L, 153 LB, 153 V

[56] References Cited

U.S. PATENT DOCUMENTS

| | | | |
|---|---|---|---|
| 2,710,342 | 6/1955 | Dilley et al. | 49/334 X |
| 3,038,991 | 6/1962 | Swanton | 246/125 |
| 3,272,932 | 9/1966 | Radford | 200/38 BA |
| 3,467,800 | 9/1969 | Barr | 200/153 V |

*Primary Examiner*—Stephen G. Kunin
*Attorney, Agent, or Firm*—Charles F. Pigott, Jr.

[57] ABSTRACT

A motor controller for use in railway-crossing signal-gate mechanisms is provided herein. The controller is of a cam type which includes a cam assembly having a movable cam insert that cooperates with a cam follower and switch assembly. The switch controls the gate arm raising motor. The cam insert and cam follower are arranged such that when the gate arm approaches the upright position the cam insert slides quickly or snaps to a position, which permits the switch contacts to open quickly, thereby minimizing arcing between the switch contacts. Moreover, with the cam insert in this position, oscillation of the gate arm about the upright position, which is caused by the gate arm striking the arm stops and bouncing back, is minimized.

4 Claims, 7 Drawing Figures

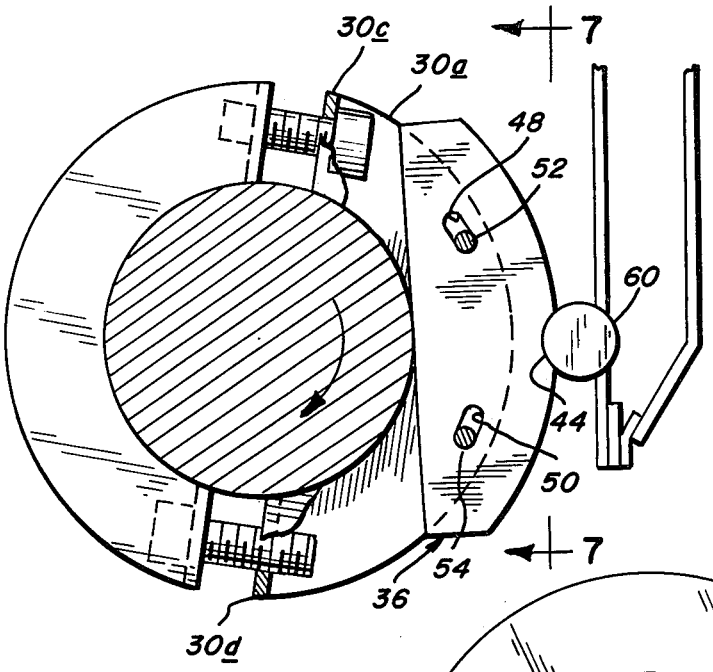
FIG. 4
FIG. 5
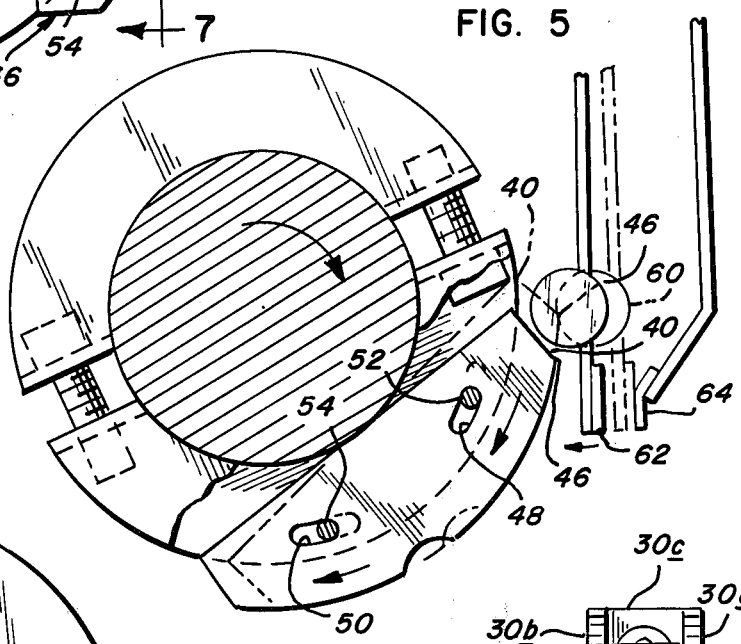
FIG. 6
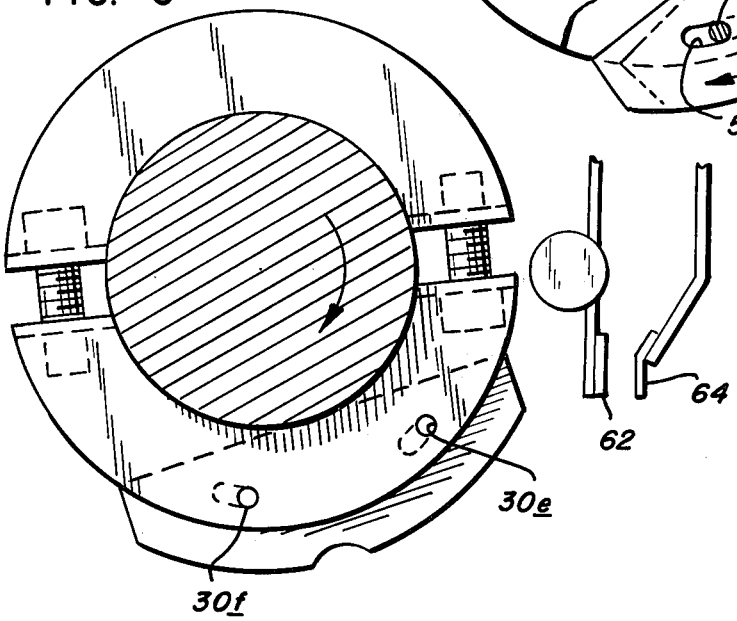
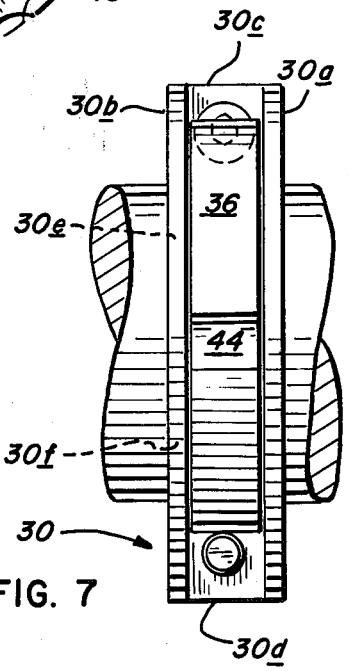
FIG. 7

SLIDE CAM ASSEMBLY FOR RAILROAD-CROSSING GATE MECHANISM

BACKGROUND OF THE INVENTION

This invention relates to railroad-crossing signal-gate mechanisms and, more particularly, to a motor controller for the use therein.

Railroad-crossing signal-gate mechanisms include a pivotally-supported gate arm which is movable between a horizontal signalling position and an upright storage or non-signalling position. The arm is mounted on a pivotable main support shaft which is driven by a motor that is controlled by a cam-type circuit controller associated with the shaft and responsive to the rotation of the shaft.

In order to raise the arm from the horizontal position to the upright position, the motor is energized and thereafter controlled and deenergized by a cam-assembly and an associated cam follower and switch assembly.

In existing circuit controllers, the cam assembly is mounted on the support shaft and engages the cam follower as the gate arm is raised so as to close the switch. When the gate arm reaches the upright position, the cam assembly and cam follower disengage, the switch opens and the arm-raising motor is deenergized. However, due to the slow rotation of the support shaft, the switch opens slowly and this has resulted in excessive arcing of the switch contact points.

It is therefore an object of this invention to provide a cam-type circuit controller in which the switch opens quickly so as to minimize arcing.

Furthermore, in existing gate control mechanisms it is possible that the gate arm may fail to lock in the upright position and thus oscillate (i.e., move back and forth) about the upright position. This is due to the gate arm swinging past the upright position, striking the gate arm stops, and bouncing back toward the horizontal position. On occasion the gate arm could bounce back sufficiently far that the cam assembly would reengage the cam follower, close the contact points, and thereby reactivate the raising motor. This process could continue indefinitely so that the arm-raising motor would be energized and deenergized on each oscillation. This has, in turn, resulted in occasional overheating and electrical failures within the mechanism.

It is therefore another object of this invention to provide an arm-raising motor controller which will minimize or eliminate arm oscillation.

These and other objects of this invention will become apparent from the following description and appended claims.

SUMMARY OF THE INVENTION

There is provided by this invention a cam-type controller for controlling the arm-raising motor which (1) permits the switch contacts to open quickly, thereby minimizing arcing and (2) prevents small oscillations of the gate arm about the upright position from reenergizing the arm-raising motor.

The controller includes: (1) a cam-assembly which is mounted on the support shaft and includes a movable cam insert; and (2) a cam follower and switch assembly for engagement and cooperation with the cam insert. The insert includes a generally arcuate main camming surface and a flat camming surface at one end of the arcuate surface, which together define a camming point. As the support shaft rotates and the gate arm approaches the upright position, the cam follower leaves the arcuate surface, moves across the camming point and onto the flat surface. The movement onto the flat surface causes the insert to quickly slide or snap to a position which permits the switch contacts to open quickly. When the gate arm is upright, the cam follower disengages the cam insert.

Moreover, once the follower disengages the cam insert, substantial bounce back of the arm is necessary before the follower can reengage the arcuate camming surface and thereby close the switch and reenergize the arm-raising motor. Thus oscillation due to bounce back and motor energization is minimized.

BRIEF DESCRIPTION OF THE DRAWINGS

FIGS. 4, 5 and 6 show the controller in different positions as the arm moves from the horizontal position with the switch contacts closed (FIG. 3) to the upright position with the switch contacts open (FIG. 6); and FIG. 7 is a front elevational view taken along line 7—7 of FIG. 4 and showing the cam assembly.

DESCRIPTION OF THE PREFERRED EMBODIMENT

General

Figure 1:
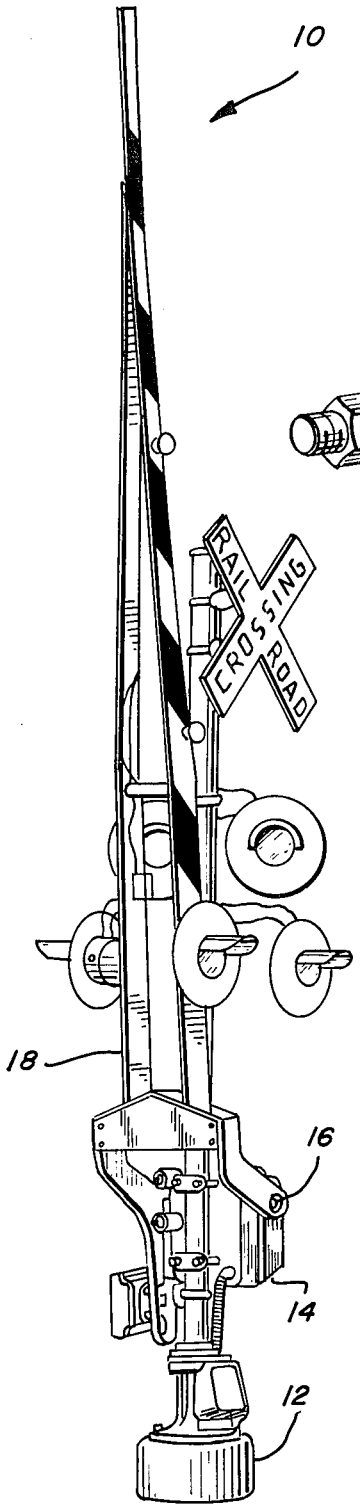
FIG. 1 is a perspective view of a railroad-crossing signal-gate mechanism.
Figure 2:
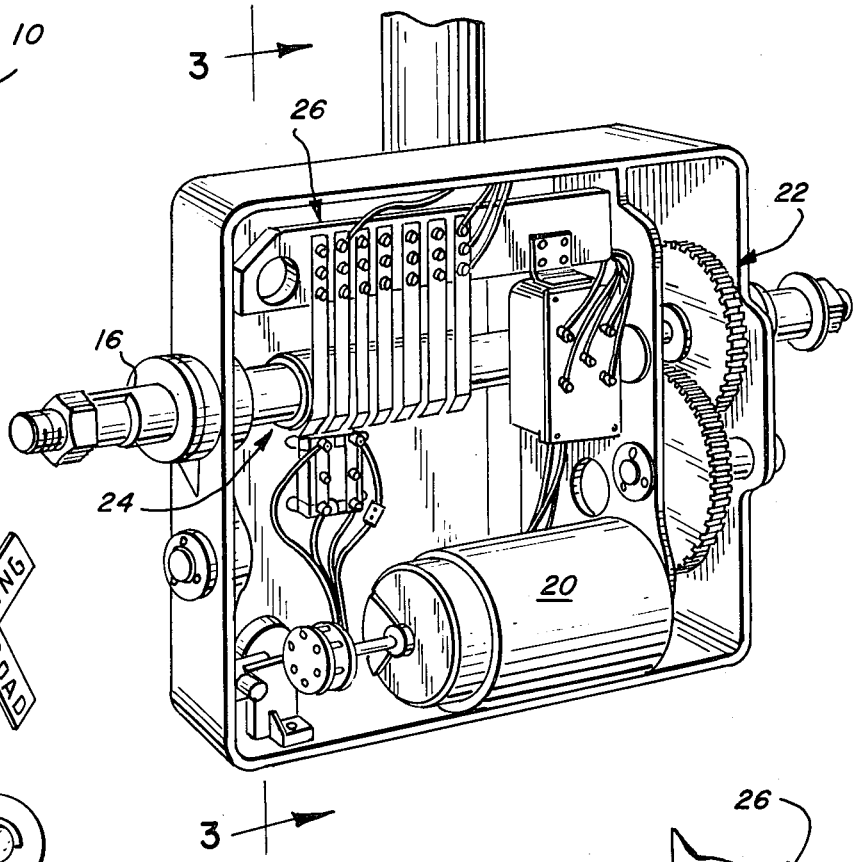
FIG. 2 is a perspective view showing interior of the gate arm controlling mechanism.

Referring now to the drawings, there is shown in FIGS. 1 and 2 a railroad-crossing signal-gate mechanism 10 generally, which includes a base 12 on which a gate control mechanism housing 14 is mounted. A horizontal gate arm support shaft 16 is mounted within the housing and its ends extend outwardly therefrom. A gate arm 18 is mounted to the ends of the shaft 16 for movement between an upright storage position and a horizontal signalling position. A motor 20 is positioned inside the housing and drives the support shaft 16 through the gear train 22.

The Motor Controller

Seven controllers or cam assemblies are mounted on the shaft 16 with the leftmost cam assembly 24 (or Cam No. 1) controlling the gate arm-raising function. The cam assembly 24 together with the cam follower and switch assembly 26 controls the raising operation of the motor 20.

Referring now to FIGS. 3–6, the cam assembly 24 includes a pair of C-shaped, saddle-like collar segments 28 and 30, which are shaped to provide a collar that fits about and securely engages the shaft 16. A pair of cap screws 32 and 34 connect the collar segments 28 and 30 and permit adjustable positioning of the collar about the shaft.

Each of the collar segments is formed by bending a flat metal ring. The segments are formed so as to provide a C-shape in side elevation and a U-shape in front elevation. For example in FIG. 7, it is seen that the segment 30 includes a pair of spaced sidewalls **30*a* and 30*b*, which are joined by a pair of bight portions 30*c*** and 30*d*. Each of the sidewalls includes two roll pin receiving apertures, such as 30*e* and 30*f*.

A slidable cam insert 36 is positioned between the sidewalls 30*a* and 30*b* of the collar segment 30. The cam insert includes an arcuately-shaped main camming surface 38 and upper and lower flat ends 40 and 42. The upper end 40 also acts as a camming surface. A laterally-extending depression or detent 44 extends across the arcuate camming surface 38 and is positioned closer to the lower end 42 than the upper end 40. The junction of the two camming surfaces 38 and 40 defines a camming line or camming point 46.

The insert also includes a pair of elongated and arcuately-shaped slots 48 and 50 which extend laterally through the insert body. The slots lie on a circle having an axis common with the axis of the arcuate camming surface. The slots are positioned such that the upper slot 48, which is closest to the flat camming surface 40, is further from the detent 44 than the lower slot 50.

The insert is held to the collar segment 30 by a pair of roll pins 52 and 54, which are press fit into the collar holes 30*e* and 30*f*, but are loosely received in the insert slots. This permits movement of the insert 36 relative to the collar segment 30. In the particular embodiment the insert can move 3/16 inch with respect to the collar.

The cam follower and switch assembly 26 is also mounted on the housing and is positioned to one side of the support shaft. The assembly 26 includes a downwardly-extending leaf-spring or arm 56, which is biased toward the shaft 16. The arm 56 is secured at one end to the housing 14 and carries, at the other end, a cam follower 60 and a switch contact 62, which is one member of a pair of electrical switch contact points. The other switch contact 64 is positioned outwardly of, but in contacting relation, to the first contact. The two contacts 62 and 64 provide the switch which controls the motor. If the switch is closed, the motor 20 may be energized, and if open, the motor 20 is deenergized.

When the gate arm 18 is in the horizontal position the cam follower 60 engages the insert 36 (FIG. 3); while when the arm 18 is in the upright position the cam follower cannot engage the insert 36 (FIG. 6)

Operation

Figure 3:
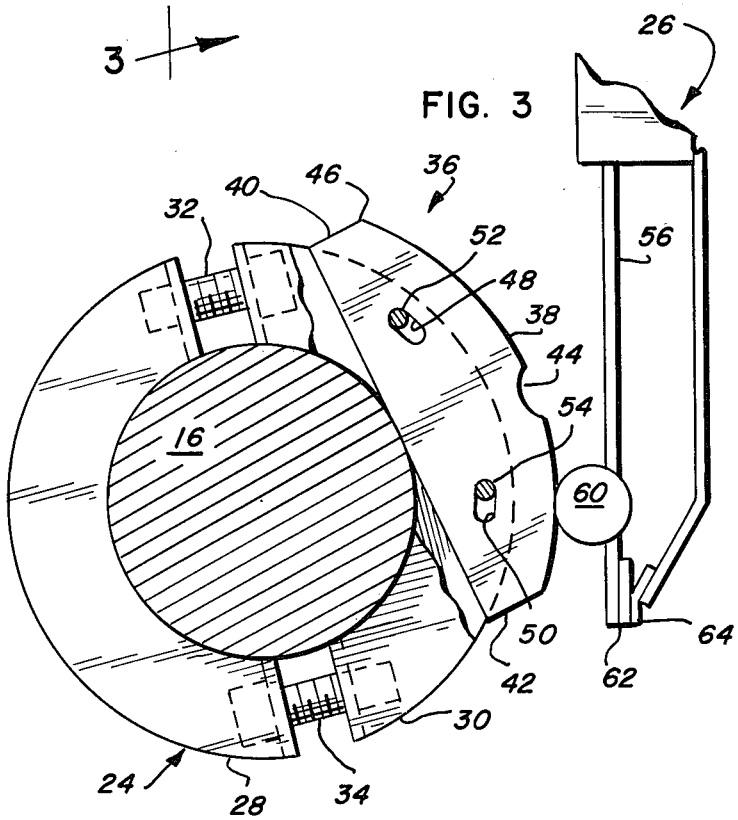
FIG. 3 is a side elevational view taken substantially along line 3—3 of FIG. 2 showing the arm-raising motor controller with the gate in the horizontal position and switch contacts closed.

When the gate arm 18 is in the horizontal or signalling position, the cam insert 36 is positioned as shown in FIG. 3. There the follower 60 engages the arcuate camming surface 38 below the detent 44, the contact points 62 and 64 are closed, and the roll pins 52 and 54 support the insert by engaging the upper or trailing ends of the slots 48 and 50. Thus the insert in a sense hangs from the roll pins.

As the gate arm 18 is raised, the support shaft 16 rotates in the clockwise direction so that the insert rotates downwardly. At one point, as shown in FIG. 4, the cam follower 60 engages the detent 44 and momentarily stops the downward movement of the insert 36 relative to the collar segment 30 and the support shaft 16. Thus the collar segment 30 moves downwardly relative to the insert 36 until the roll pins 52 and 54 engage the leading or lower edges of the cam slots 48 and 50; in this embodiment the relative movement is 3/16 inch. When the roll pins 52 and 54 engage the leading edges of the slots, the insert is pulled downwardly and the detent is pulled from engagement with the follower. However, the biasing action of the follower 60 against the cam insert 36 maintains the leading or lower edges of the slots in engagement with the roll pins.

As the gate arm approaches the upright position (i.e., 89° from horizontal) as shown in FIG. 5, the follower 60 moves out of engagement with the arcuate camming surface 38, across the camming point 46, and onto the flat camming surface 40. As this occurs, the follower urges the insert 36 downwardly and gravity also acts to move the insert downwardly. By this action, the insert snaps downwardly or moves downwardly faster than the shaft rotates until the trailing edges of the slots 48 and 50 engage the roll pins 52 and 54. This quick downward movement or snap-action of the insert permits the follower to move quickly toward the shaft which, in turn, results in a quick opening of the contact points 62 and 64, thereby minimizing arcing. At 90°, or when the arm is fully upright, the cam insert 36 is positioned below the cam follower 60 and thus in the upright position the cam follower cannot engage the insert and the switch contacts 62 and 64 are open.

It is possible that the gate arm 18 can move past the upright or 90° position, strike the arm stops (not shown) and bounce back through the upright position and toward the down position. If this were to occur, the motor 20 would not be reenergized until: (1) the gate arm moved downwardly and substantially past the upright position; and (2) the cam follower reengaged the upper camming surface, moved over the camming point, and onto the arcuate surface. Such substantial movement is required due to the downward positioning of the insert 36 relative to the support shaft when the gate arm is upright. Therefore, due to the substantial arm rotation which is required before the cam follower reengages the arcuate camming surface, closing of the contact points 62 and 64 is delayed, and oscillation of the gate arm due to the motor being energized and deenergized is minimized.

It will be appreciated that numerous changes and modifications can be made to the embodiment shown herein without departing from the spirit and scope of this invention.

What is claimed and desired to be secured by Letters Patent of the United States is:

1. Motor control apparatus for controlling a drive motor of a railroad crossing gate mechanism of the type wherein a gate arm is mounted on a horizontally disposed rotatable shaft and a drive motor is utilized to rotate the shaft for moving the gate arm between horizontal and upright positions, said motor control apparatus comprising, in combination, cam follower and switch means associated with said drive motor for starting and stopping the same; collar means engaged around said shaft for conjoint rotation therewith; a cam segment having an arcuate radially outer cam surface extending less than 180 degrees relative to the circumference of said collar and carried on said collar for engagement with said cam follower to close said switch means, said cam segment being mounted on said collar so as to be circumferentially slidable thereon a limited distance relative to said collar; said collar, cam segment and cam follower means being relatively positioned so that said cam segment moves downwardly relative to said cam follower during raising of said gate arm, and as the gate arm reaches its upright position said outer cam surface disengages from said cam follower permitting said switch to open; and said cam segment being located generally to one side of said shaft at the point of disengagement, whereby gravity will assist said cam follower in displacing said cam segment downwardly to its lowermost position relative to said collar, thereby creating a predetermined gap between said cam segment and said cam follower in the upright position of said gate arm.

2. Motor control apparatus as defined in claim 1 where a second cam surface is formed on the upper end of said cam segment, said second cam surface being approximately perpendicular to the base of said cam segment so as to cooperate with said cam follower and thereby urge said cam segment toward said lowermost position when said outer cam surface disengages from said cam follower.

3. Motor control apparatus as defined in claim 1 where a detent is formed in the arcuate outer cam surface of said cam segment for momentary engagement with said cam follower during raising of the gate arm, thereby causing said cam segment to shift to its uppermost position relative to said collar, said detent being located intermediate the ends of said cam segment.

4. Motor control apparatus as defined in claim 1 where elongated slots are formed in said cam segment and pin means extend through said slots and are fixed to said collar, whereby the amount by which said cam segment is slidable relative to said collar is controlled by the length of said slots.

* * * * *